US007749139B2

(12) United States Patent
Wang

(10) Patent No.: US 7,749,139 B2
(45) Date of Patent: Jul. 6, 2010

(54) ELLIPTICAL CROSS TRAINER

(76) Inventor: Leao Wang, No. 1, Lane 233, Sec. 2, Charng Long Rd., Taiping (TW) 411

( * ) Notice: Subject to any disclaimer, the term of this patent is extended or adjusted under 35 U.S.C. 154(b) by 300 days.

(21) Appl. No.: 12/021,279

(22) Filed: Jan. 28, 2008

(65) Prior Publication Data

US 2009/0192023 A1 Jul. 30, 2009

(51) Int. Cl.
*A63B 69/16* (2006.01)

(52) U.S. Cl. ..... 482/57; 482/63; 482/62

(58) Field of Classification Search ..... None
See application file for complete search history.

(56) References Cited

U.S. PATENT DOCUMENTS

2007/0015633 A1* 1/2007 Gerschefske et al. ..... 482/52
2008/0051258 A1* 2/2008 Schmehl et al. ..... 482/52
2008/0242516 A1* 10/2008 Lu et al. ..... 482/52
2008/0287265 A1* 11/2008 Giannelli et al. ..... 482/52
2009/0005222 A1* 1/2009 Liao et al. ..... 482/52

* cited by examiner

*Primary Examiner*—Jerome Donnelly

(57) ABSTRACT

An elliptical cross trainer having a double-recessed crank in match of a load-coupling mechanism installed at the external side of a crank support. In this way, the gap of two pedal planks arranged parallel to each other can be reduced, thereby achieving the natural opening space of both human feet. Meanwhile, a hanging support together with suspension arm is connected with two pedal planks such that the pedal planks can create an optimal exercise path corresponding to the exercise pace of both human feet.

4 Claims, 5 Drawing Sheets

ELLIPTICAL CROSS TRAINER

BACKGROUND OF THE INVENTION

1. Fields of the Invention

The invention relates to an elliptical cross trainer, and more particularly, to a structure that ensures a minimal gap between pedal planks and provides an optimal exercise path.

2. Description of the Related Art

As well known to those skilled in the art, all kinds of the current elliptical cross trainers includes a load mechanism interposed between two pedal planks such that a certain gap between both pedal planks is produced. When an operator stands on them for use, both feet will be forced to open in an unpleasant way in conducting the so-called elliptical exercise. In fact, nobody would open in such an unpleasant way in walking or jogging on a flat ground. Thus, the design of the above-mentioned elliptical cross trainer definitely requires further improvement.

Moreover, the pedal planks of many elliptical cross trainers has one end pivotally connected to the crank while the other end thereof is directly situated in pivotal connection to the coupling handrails for achieving the effect of the natural movement of both hands and feet. However, the nearly mechanic type exercise path does not comply with the natural rhythm of the human feet. The reason for that lies in that the buffering process of the instant displacement (the shift of the center of gravity) created during the forward movement in lifting the feet is not properly taken into account. The time of the buffering process of the instant displacement is very short. However, this process is a very important exercise step. Otherwise, it would easily cause unnecessary injuries of the operator.

SUMMARY OF THE INVENTION

An object of the invention is to eliminate the above-mentioned drawbacks and to provide an elliptical cross trainer that tries to reduce the gap between two pedal planks. Meanwhile, a hanging support and suspension arms are employed in such a way that the pedal planks produce an exercise path fully comply with the requirements of the instant shift buffering process. In this way, the exercise injuries can be effectively avoided.

According to the invention, an elliptical cross trainer includes a double-recessed crank in match of a load-coupling mechanism installed at the external side of a crank support. In this way, the gap of two pedal planks arranged parallel to each other can be reduced, thereby achieving the natural opening space of both human feet. Meanwhile, a hanging support together with suspension arm is connected with two pedal planks such that the pedal planks can create an optimal exercise path corresponding to the exercise path and pace of both human feet.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

The present invention will now be described in more detail hereinafter with reference to the accompanying drawings that show various embodiments of the invention.

Figure 1:
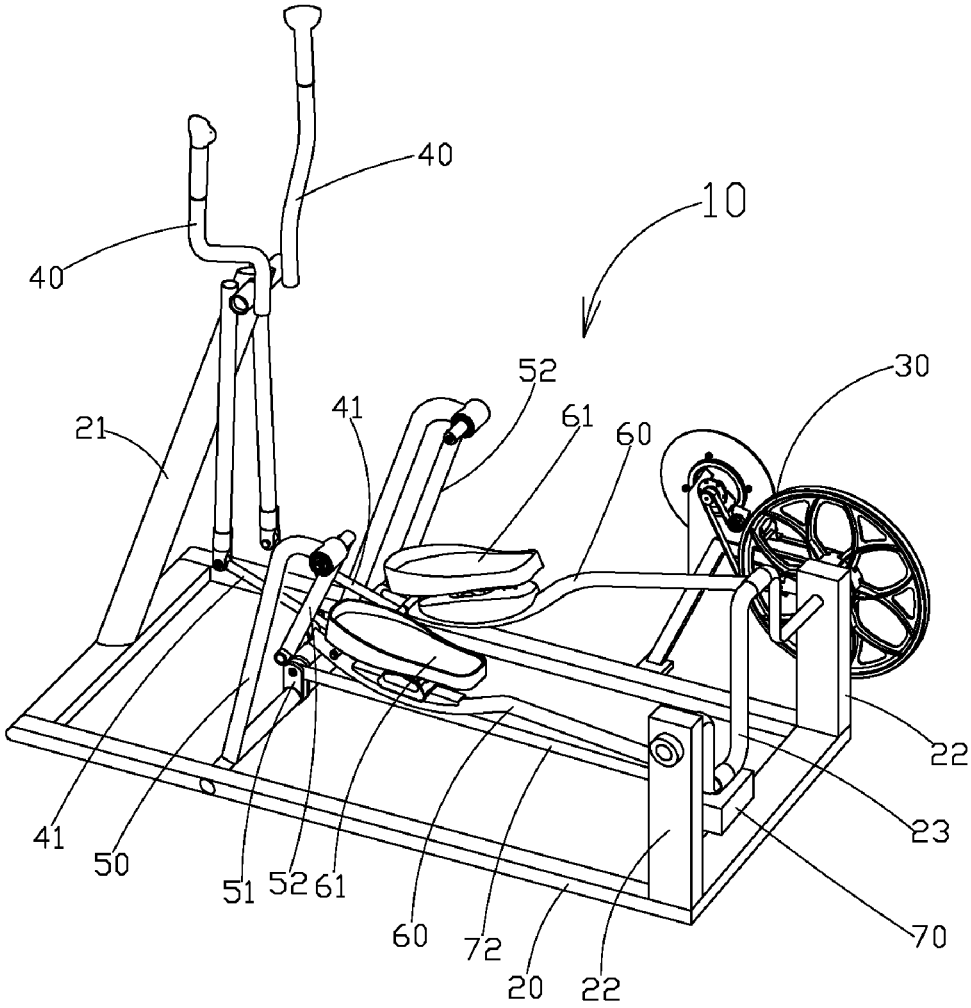
FIG. 1 is a perspective view of a preferred embodiment of the invention.
Figure 2:
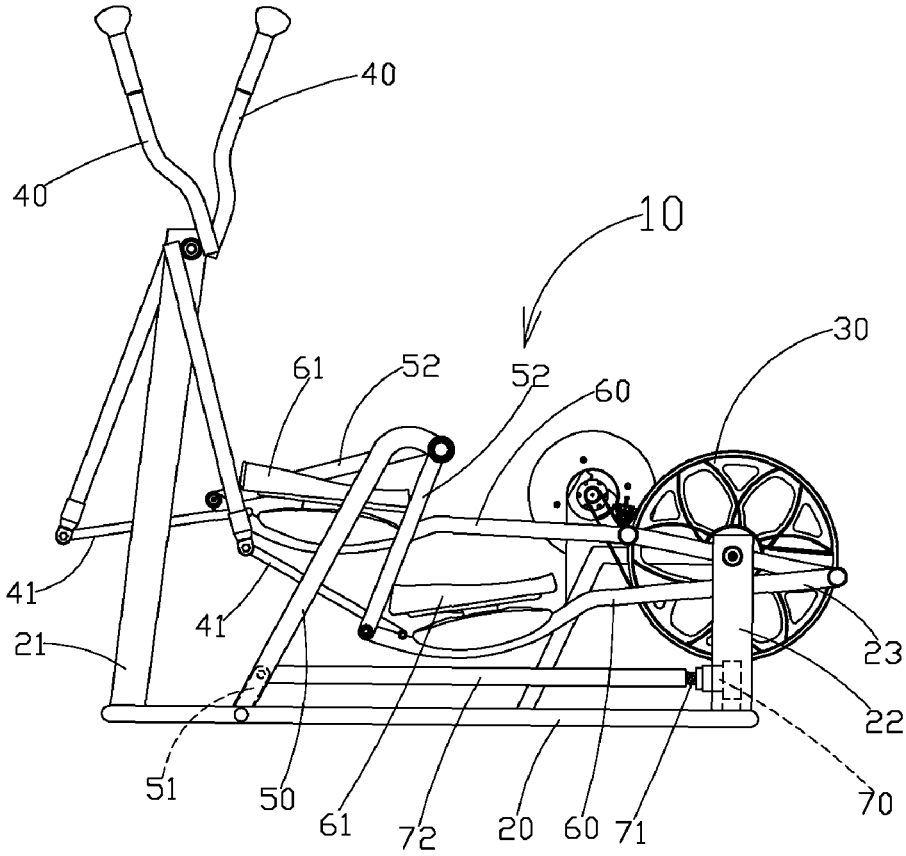
FIG. 2 is a side view of the preferred embodiment of the invention according to FIG. 1.
Figure 3:
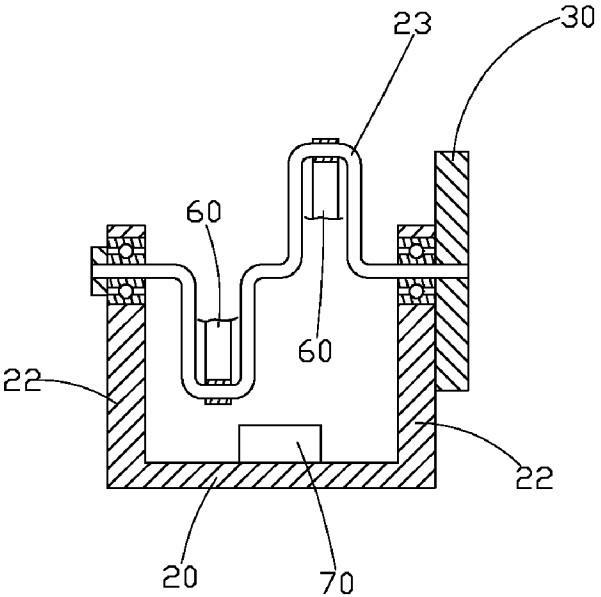
FIG. 3 is a partially cutaway view of the structure according to FIG. 1.

Referring to FIGS. 1 through 3, an elliptical cross trainer 10 in accordance with the invention includes a base 20, a load-coupling mechanism 30, two handrails 40, a hanging support 50, two pedal planks 60, and an electric adjusting unit 70.

The base 20 includes a front support 21 at the front end thereof and two crank supports 22 at the rear end thereof. A double-recessed crank 23 is interposed between two crank supports 22.

The load-coupling mechanism 30 is disposed at the external side of the crank supports 22 and driven by the double-recessed crank 23.

The handrails 40 are pivotally coupled at both sides of the front support 21. A coupling rod 41 is pivotally connected to the bottom of the handrails 40, respectively. The other end of the coupling rod 41 is pivotally attached to the pedal planks 60 in a coupling state.

The hanging support 50 is pivotally connected to the base 20 and includes a connecting piece 51 at the center thereof. The hanging support 50 is pivotally coupled with a suspension arm 52 at the top of both sides thereof, respectively. The bottom of the suspension arm 52 is pivotally coupled with the front end of the corresponding pedal plank 60.

The pedal planks 60 each includes a pedal 61 at the top thereof. The rear end of the pedal plank 60 is pivotally connected in the recess of the double-recessed crank 23.

The electric adjusting unit 70 is installed at the rear end of the base 20 and includes a spindle 71 for imparting a linear motion to a driving tube 72. The other end of the driving tube 72 is pivotally connected to the connecting piece 51 of the hanging support 50.

Figure 4:
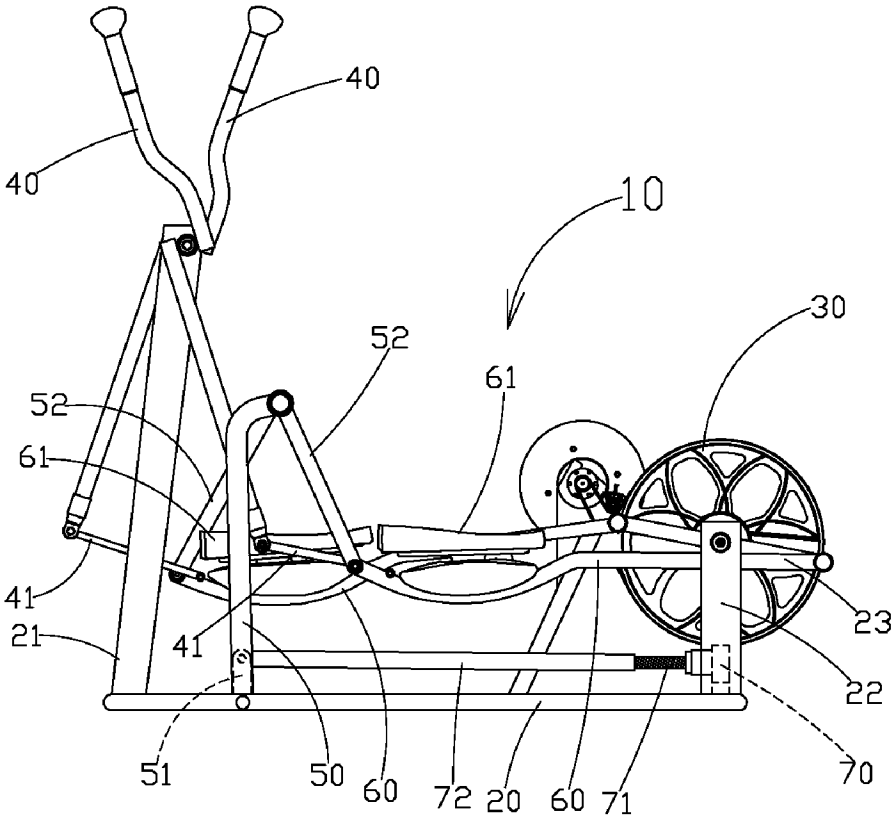
FIG. 4 is a side view of the operation according to FIG. 1.

Based on the assembly of the above-mentioned components, the gap between the pedal planks 60 is considerably reduced. An optimal exercise path is achieved by the installation of the suspension arm 52. As shown in FIG. 4, the exercise slope of the pedal planks 60 can be adjusted by the electric adjusting unit 70 in match of the spindle 71 and the driving tube 72.

Figure 5:
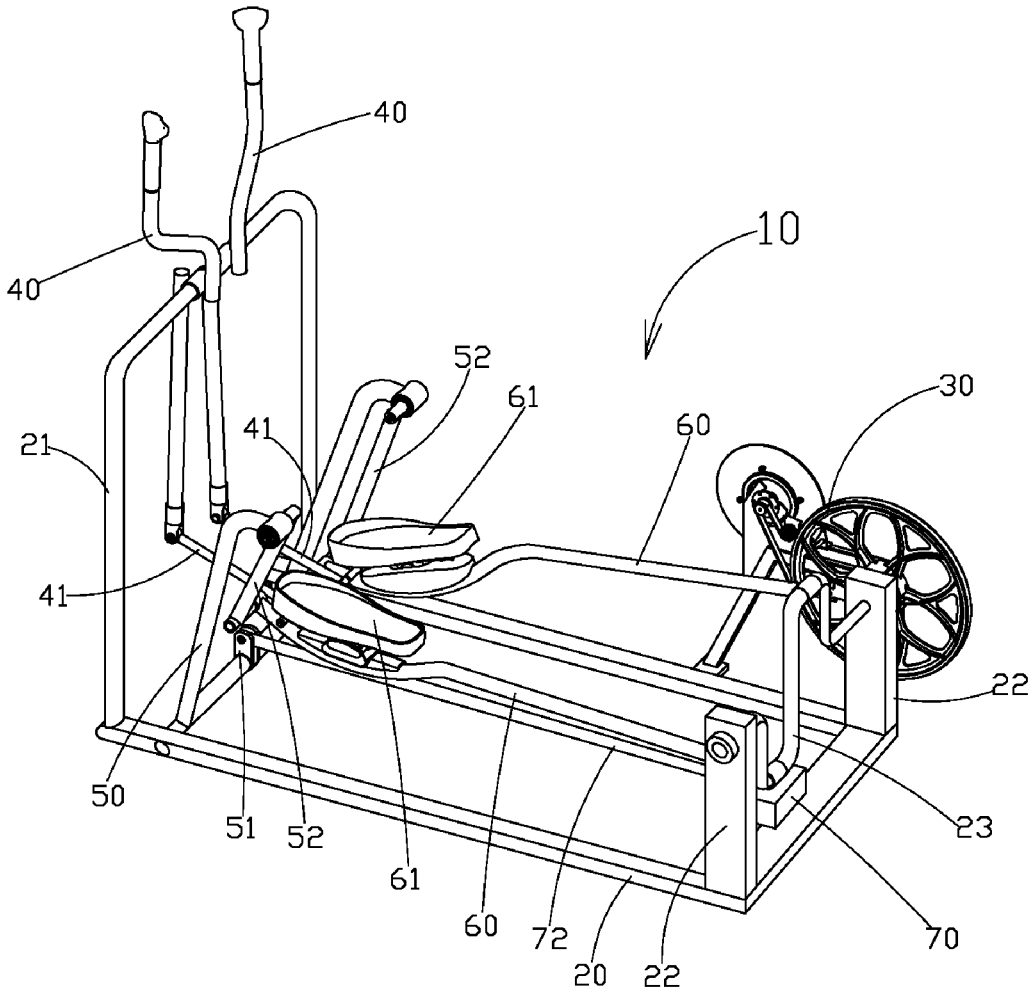
FIG. 5 is a perspective view of another embodiment of the invention.

Referring to FIG. 5, the front support 21 can be installed at both sides of the front end of the base 20 and extended to the opposing internal side. This can also achieve a prearranged effect of pivotally connecting the handrails 40.

Figure 6:
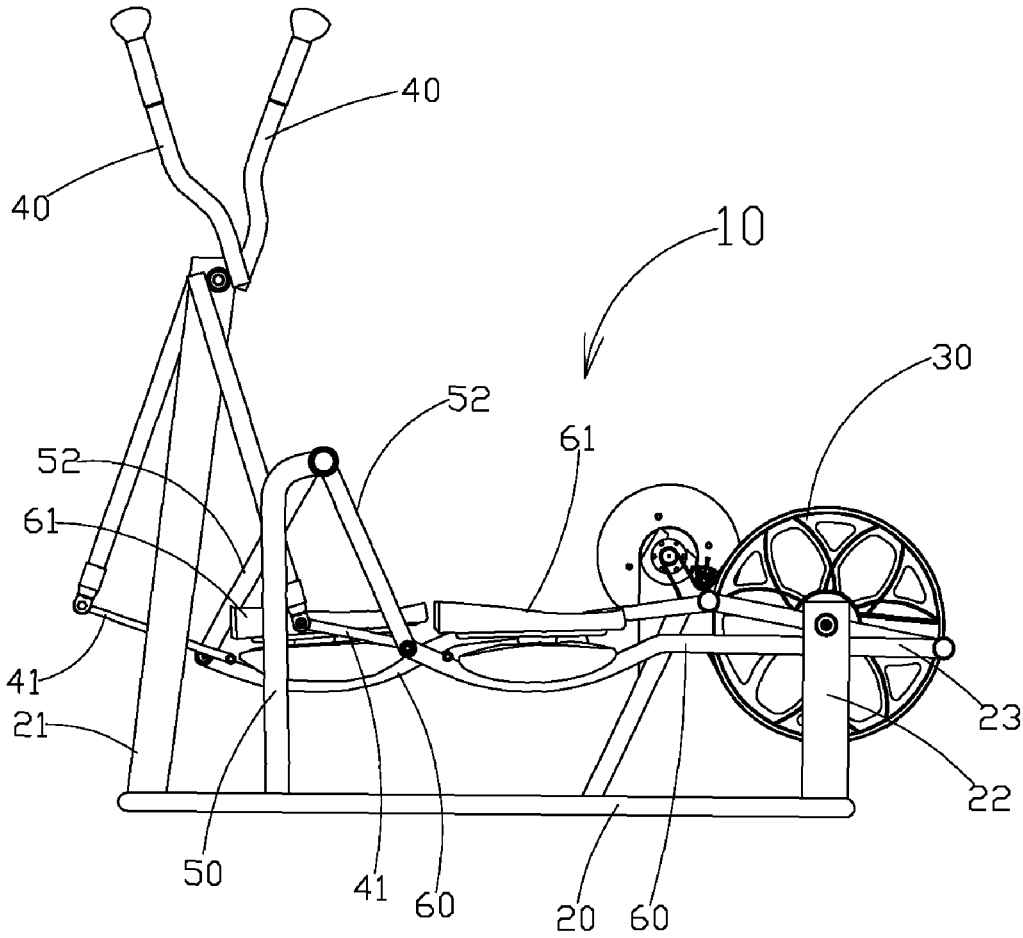
FIG. 6 is a side view of a further embodiment of the invention.

Referring to FIG. 6, the hanging support can be arranged at a fixed angle. That is, the electric adjusting unit 70, the spindle 71, the driving tube 72 and the connecting piece 51 can be omitted without affecting the expected effect.

Referring to FIG. 8, more than one annular groove 84 is formed in the polygonal portion 82 of the above-mentioned socket 80. The annular groove 84 can be filled with a colored paint as an identification label for an easy identification of the item number, size, type, etc.

The assembly element of the invention has a wide application scope and includes almost all of the assembly elements of hand tools. It is difficult to show all of them with drawings. As a result, any elements that are added or equivalent to the invention should fall within the scope of the invention.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. An elliptical cross trainer, comprising:

a) a base having a front support at a front end of the base and two crank supports at a rear end of the base, a double-recessed crank being interposed between the two crank supports;

b) a load-coupling mechanism disposed at an external side of the crank supports and driven by the double-recessed crank;

c) two handrails pivotally coupled at both sides of the front support, a coupling rod being pivotally connected to the bottom of the handrails, the other end of the coupling rod being pivotally attached to pedal planks in a coupling state;

d) a hanging support pivotally connected to the base and having a connecting piece at the center thereof, the hanging support being pivotally coupled with a suspension arm at a top of both sides thereof, respectively, a bottom of the suspension arm being pivotally coupled with a front end of the corresponding pedal plank;

e) the two pedal planks each having a pedal at a top thereof, a rear end of the pedal plank being pivotally connected in a recess of the double-recessed crank; and f) an electric adjusting unit installed at the rear end of the base and having a spindle for imparting a linear motion to a driving tube, another end of the driving tube being pivotally connected to the connecting piece of the hanging support.

2. The elliptical cross trainer as recited in claim 1, wherein the front support is installed at both sides of the front end of the base and extended to an opposing internal side.

3. An elliptical cross trainer, comprising:

a) a base having a front support at a front end of the base and two crank supports at a rear end of the base, a double-recessed crank being interposed between the two crank supports;

b) a load-coupling mechanism disposed at an external side of the crank supports and driven by the double-recessed crank;

c) two handrails pivotally coupled at both sides of the front support, a coupling rod being pivotally connected to a bottom of the handrails, another end of the coupling rod being pivotally attached to pedal planks in a coupling state;

d) a hanging support pivotally connected to the base, the hanging support being pivotally coupled with a suspension arm at a top of both sides thereof, respectively, a bottom of the suspension arm being pivotally coupled with a front end of the corresponding pedal plank; and e) the two pedal planks each having a pedal at a top thereof, a rear end of the pedal plank being pivotally connected in a recess of the double-recessed crank.

4. The elliptical cross trainer as recited in claim 3, wherein the front support is installed at both sides of the front end of the base and extended to an opposing internal side.

* * * * *